US005963511A

United States Patent [19]

Huter

[11] Patent Number: 5,963,511

[45] Date of Patent: Oct. 5, 1999

[54] TIMEPIECE WITH MECHANISM FOR SETTING THE HANDS BY DIRECT ACTION OF THE PULL-OUT PIECE

[75] Inventor: Marc Huter, Biel, Switzerland

[73] Assignee: Eta Sa Fabriques D'Ebauches, Grenchen, Switzerland

[21] Appl. No.: 08/877,877

[22] Filed: Jun. 18, 1997

[30] Foreign Application Priority Data

Jun. 26, 1996 [FR] France ..... 96 07944

[51] Int. Cl.[6] ..... G04B 27/02

[52] U.S. Cl. ..... 368/196; 368/197

[58] Field of Search ..... 368/190, 196, 368/191, 192, 193, 194

[56] References Cited

U.S. PATENT DOCUMENTS

| | | | |
|---|---|---|---|
| 355,752 | 1/1887 | Bachner . | |
| 371,539 | 10/1887 | Bachner . | |
| 468,204 | 2/1892 | Moreland | 368/196 |
| 3,756,015 | 9/1973 | Saito et al. | 368/22 |
| 3,844,107 | 10/1974 | Guyot | 368/22 |
| 4,363,554 | 12/1982 | Schaffner et al. | 368/190 |
| 4,469,448 | 9/1984 | Muller | 368/196 |
| 4,555,185 | 11/1985 | Vuilleumier | 368/190 |

FOREIGN PATENT DOCUMENTS

| | | |
|---|---|---|
| 613588 | 10/1979 | Switzerland . |
| 2086101 | 6/1982 | United Kingdom . |

*Primary Examiner*—Bernard Roskoski
*Attorney, Agent, or Firm*—Sughrue, Mion, Zinn, Macpeak & Seas, PLLC

[57] ABSTRACT

Analogue display timepiece comprising a mechanism for hand setting via direct action of a pull-out piece (4) on an intermediate wheel (10) mobile along a shaft perpendicular to the general plane of the plate (P) of said timepiece between at least one neutral position in which said intermediate wheel (10) is disengaged from a motion-work wheel (20) and a hand setting position in which it meshes with said motion-work wheel (20), said intermediate wheel (10) being moved from one position to the other by translation of a hand setting stem (1) by being drawn at its base (12) by resilient means (15) into the hand setting position and being brought into a neutral position by an arm (7) of the pull-out piece (4) acting directly on the head (11) of the intermediate wheel in order to oppose the resilient means (15).

4 Claims, 3 Drawing Sheets

TIMEPIECE WITH MECHANISM FOR SETTING THE HANDS BY DIRECT ACTION OF THE PULL-OUT PIECE

BACKGROUND OF THE INVENTION

The present invention concerns a timepiece comprising a mechanism for setting the hands via direct action of the pull-out piece on a motion-work intermediate wheel, said mechanism allowing a rocking bar to be omitted as a result of the particular configuration of said pull-out piece.

The invention concerns more particularly an analogue display watch fitted with such a hand setting mechanism.

In order to carry out the disengagement of a motion-work intermediate wheel and conversely, the engagement or meshing thereof in order to perform hand setting, various mechanisms have been proposed.

For example, Swiss patent No 583 933 discloses a mechanism wherein the disengagement of an intermediate wheel, held in a meshed position by a resilient tongue, is obtained via the action of a conical shoulder at the end of the winding stem on the end of the intermediate wheel shaft.

In other more common solutions, the movement imparted to the winding stem allows actuation of a pull-out piece which acts on an intermediate mobile element, generally formed by a rocking bar one arm of which causes the disengagement or meshing of an intermediate wheel with the motion-work wheel. This principle has given rise to numerous alternatives. By way of example, Swiss patent No 613 588 may be cited, wherein the disengaged position, also called the neutral position, or the meshed position for hand setting, is obtained via the vertical displacement, i.e. perpendicular to the general plane of the watch, of a sliding pinion by means of a bent strip acting as a rocking bar in a plane perpendicular to the general plane of the watch, said strip being itself acted upon by an arm of the pull-out piece which is controlled by the hand setting stem.

SUMMARY OF THE INVENTION

The mechanism according to the present invention belongs to the preceding category, but differs in that the kinematic chain is shorter as a result of a simplified construction wherein the intermediate mobile element, interposed between the pull-out piece and a sliding pinion to allow meshing or disengagement of the motion-work wheel, is omitted.

The invention thus concerns a timepiece having at least one analogue display comprising a mechanism for hand setting by means of an intermediate wheel delimited by a head and a base mobile along a shaft perpendicular to the general plane of the plate of said timepiece between at least one neutral position in which said intermediate wheel is disengaged from a motion-work wheel and a hand setting position in which it meshes with said motion-work wheel, said intermediate wheel being moved from one position to the other by translation of a hand setting stem provided with a circular groove co-operating with a pull-out piece, characterised in that the intermediate wheel is drawn at its base by resilient means into the hand setting position and in that the pull-out piece comprises an arm able to act directly on the head of the intermediate wheel in order to oppose the resilient means and to bring said intermediate wheel into a neutral position.

The resilient means are for example formed by a coupling spring. In the example which will be described in more detail hereinafter, the hand setting mechanism comprises a strip-spring one end of which is fixed onto the plate.

When the pull-out piece is pivoted, the action of the pull-out piece arm on the head of the intermediate wheel is facilitated by giving the end of the arm an inclined shape outwards from the general plane of the timepiece and by arranging a chamfer on said end of the intermediate wheel. Equally, the arm of the pull-out piece may comprise a simple chamfer and the end of the intermediate wheel may have a conical or truncated shape.

BRIEF DESCRIPTION OF THE DRAWINGS

Other features and advantages of the invention will appear more clearly upon reading the detailed description which follows, made with reference to the attached drawings which are given here solely by way of example and in which.

DETAILED DESCRIPTION OF THE PREFERRED EMBODIMENTS

Figure 1:
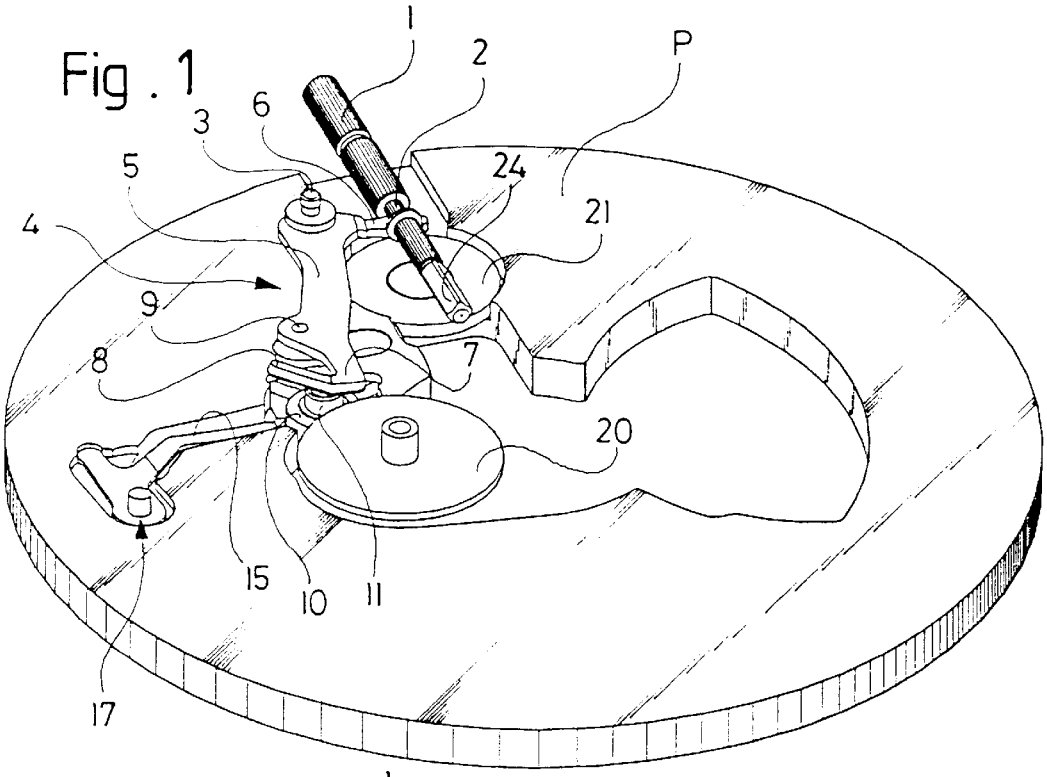
FIG. 1 is a perspective view of the mechanism in a neutral position.
Figure 2:
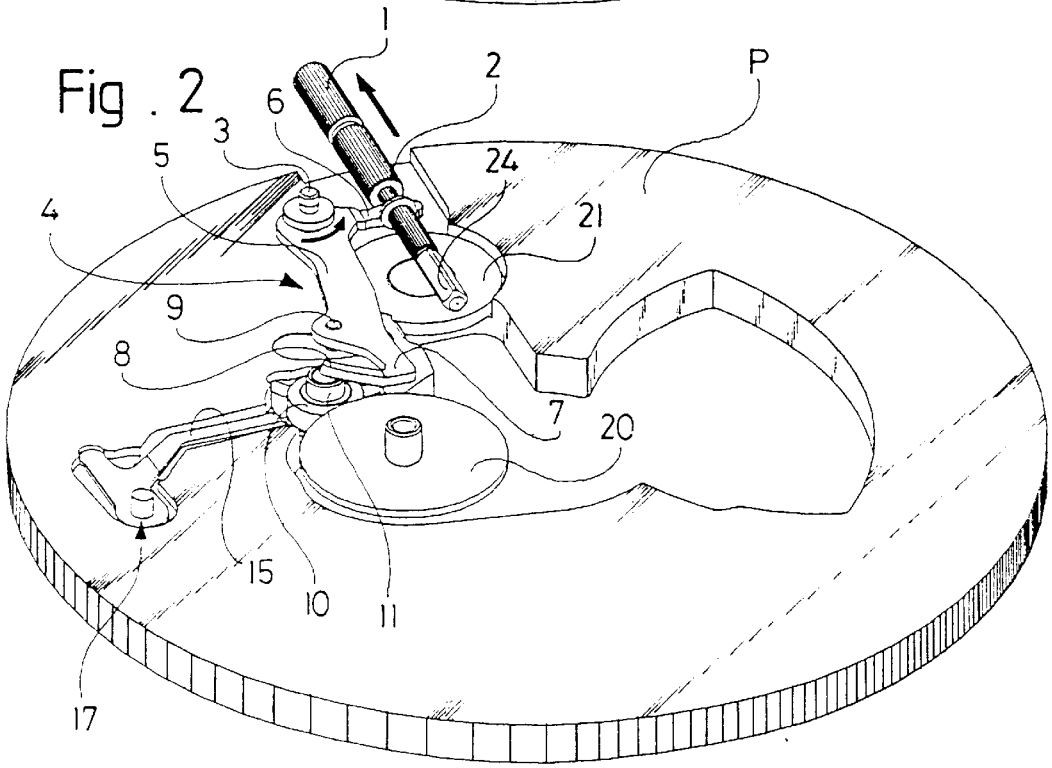
FIG. 2 is a perspective view of the mechanism in the hand setting position.

FIGS. 1 and 2 show in perspective only the hand setting mechanism, respectively in a neutral position when the stem is pushed in and in a hand setting position when the stem is pulled out. The movement of the timepiece and its display means via hands are not shown since they are part of the general knowledge of the man skilled in the art.

Referring to FIG. 1, it is seen that the mechanism basically comprises, on a plate P defining a general plane of the timepiece, a stem 1 allowing a pull-out piece 4 to be actuated, such pull-out piece acting directly on an intermediate wheel 10, which is mobile on a shaft 13 —visible in the cross-section figures—perpendicular to the general plane of the timepiece, by exerting pressure along the direction of shaft 13 against the resilient force of a coupling spring 15, thereby holding intermediate wheel 10 disengaged from motion-work wheel 20. In the neutral position, the motion-work wheel which drives the hand display is thus completely disengaged from the kinematic chain of the hand setting. Pull-out piece 4 consists of a body 5 of generally elongated shape one end of which is pivoted on the plate on a stud 3 and comprises a control arm 6 oriented substantially perpendicularly to body 5 and co-operating with a circular groove 2 of stem 1, and the other end of which comprises a second arm 7, having an end 8 which is inclined outwards from plate P.

Figure 3:
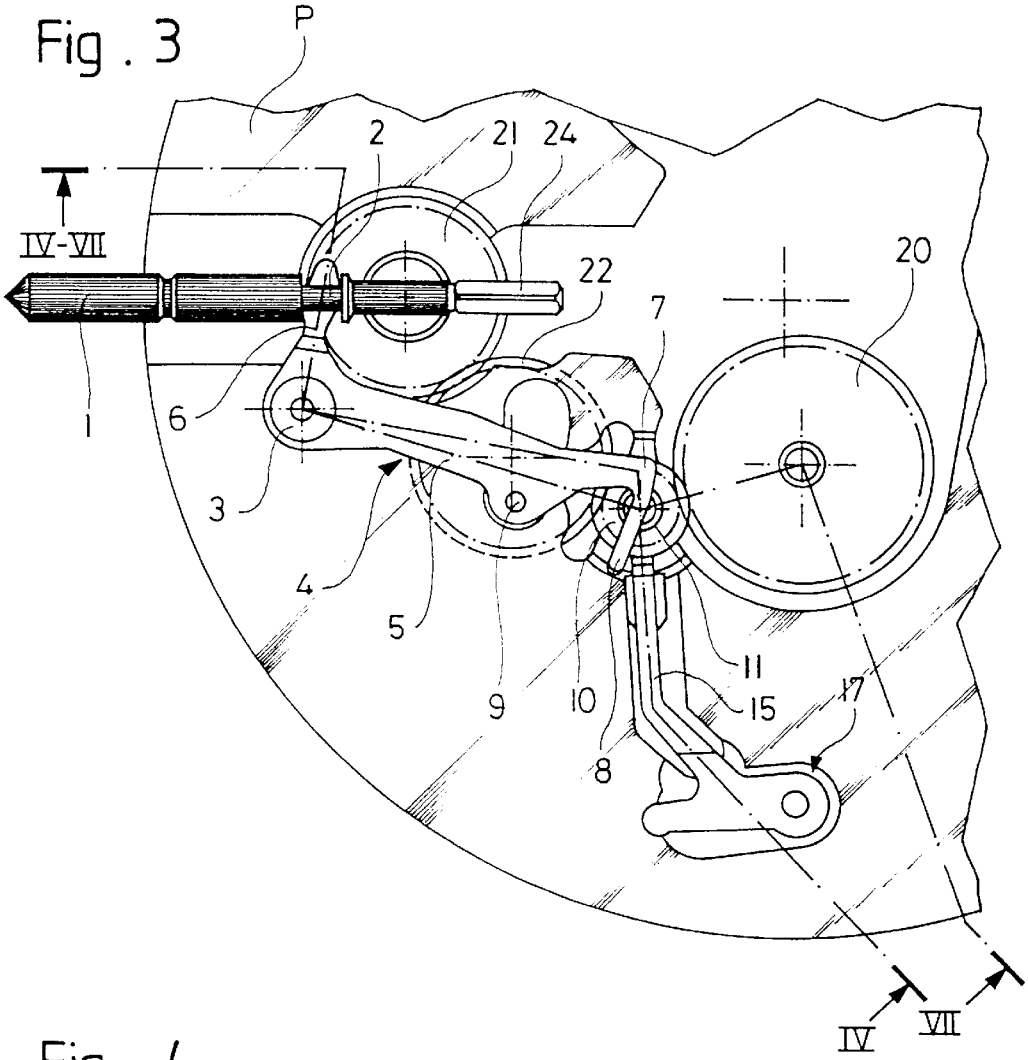
FIG. 3 is a partial top view of FIG. 1.
Figure 4:
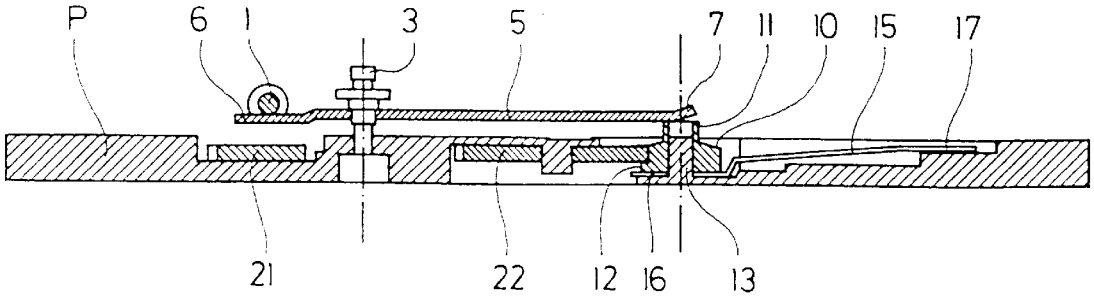
FIG. 4 is a cross-section view, in small scale, along the line IV—IV of FIG. 3 passing through the coupling spring.

In the neutral position shown in FIGS. 1, 3 and 4, arm 7 abuts head 11 of intermediate wheel 10 by opposing the contrary force exerted by strip-spring 15 the free end 16 of which acts upon base 12 of the intermediate wheel and the other end 17 of which is attached to the plate, so that motion-work wheel 20 is disengaged from the intermediate wheel.

Figure 5:
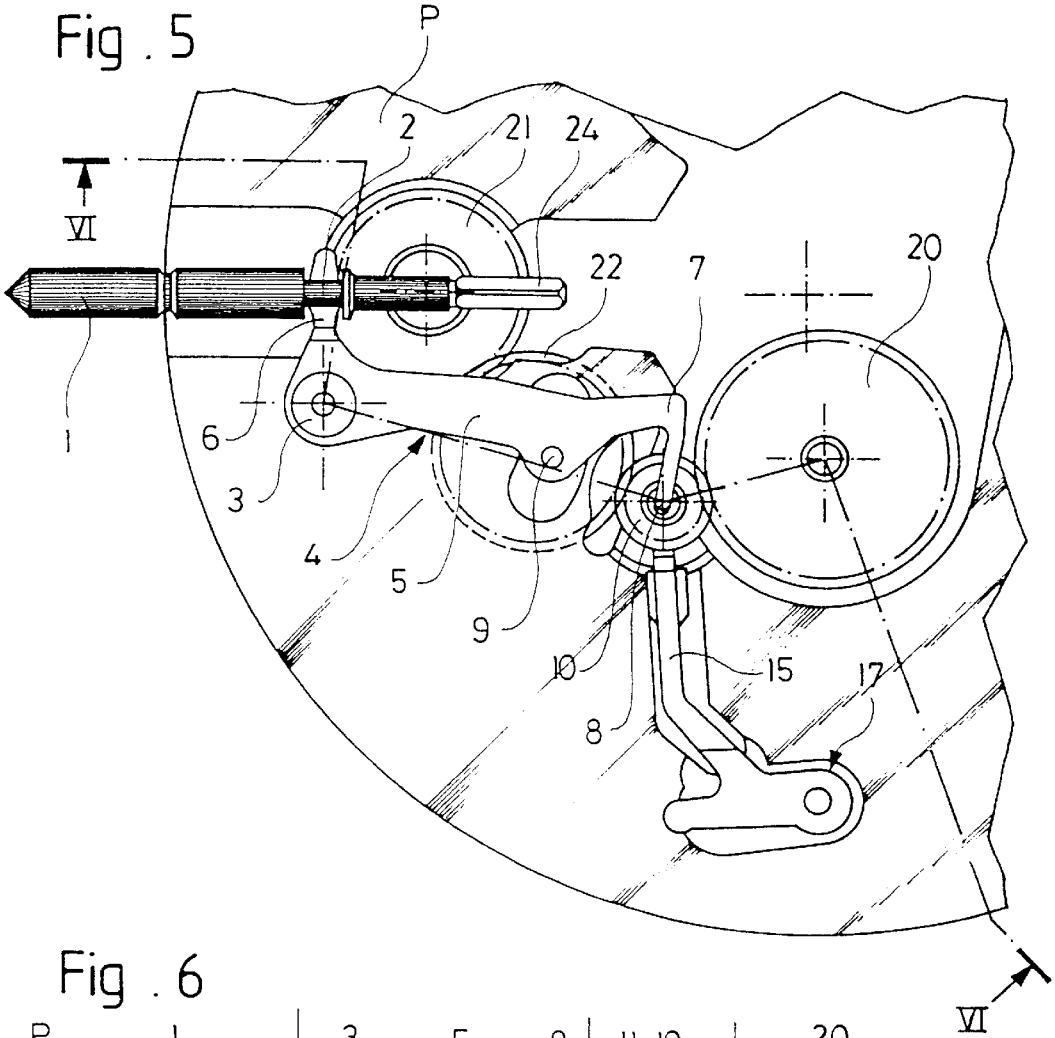
FIG. 5 is a partial top view of FIG. 2.
Figure 6:
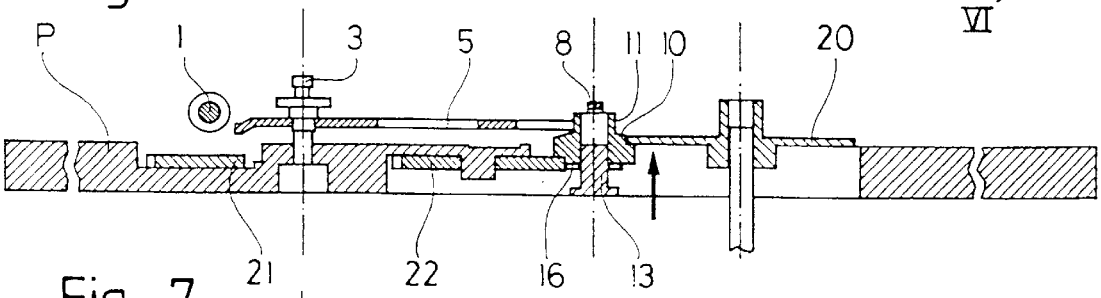
FIG. 6 is a cross-section view, in small scale, along the line VI—VI of FIG. 5 passing through the motion-work wheel.

In the hand setting position shown in FIGS. 2, 5 and 6, stem 1 has been pulled in the direction represented by the arrow in FIG. 2, which has caused the pivoting of pull-out piece 4 about stud 3, thus allowing bent end 8 of arm 7 to release intermediate wheel 10 which moves via the action of spring 15 along its shaft 13 to mesh with motion-work wheel 20.

FIGS. 3 and 5 are top views corresponding to the positions shown in FIGS. 1 and 2 and allowing the operation of the mechanism according to the invention to be better understood.

Referring now to FIG. 4, the cross-section along the broken line IV—IV of FIG. 3 shows successively, from left to right, the plate, then the median part of the control arm 6 up until stud 3, body 5 of pull-out piece 4 up until arm 7 and finally intermediate wheel 10 the base 12 of which is acted upon by coupling spring 15 which is attached to plate P via its end 17. It is to be noted that this strip-spring may be a resilient part assuring only the coupling or meshing function, or conversely, an element of a part assuring other functions, such as a arm of a jumper. Likewise, pull-out piece 4 may comprise meshing elements for other functions as is shown schematically by pin 9, visible in the perspective views and the top views.

As regards the hand setting kinematic chain, FIGS. 3 and 4 also show a first intermediate wheel 21 meshed with a second intermediate wheel 22, which is itself permanently meshed with intermediate wheel 10, whatever its position along its shaft 13.

Figure 7:
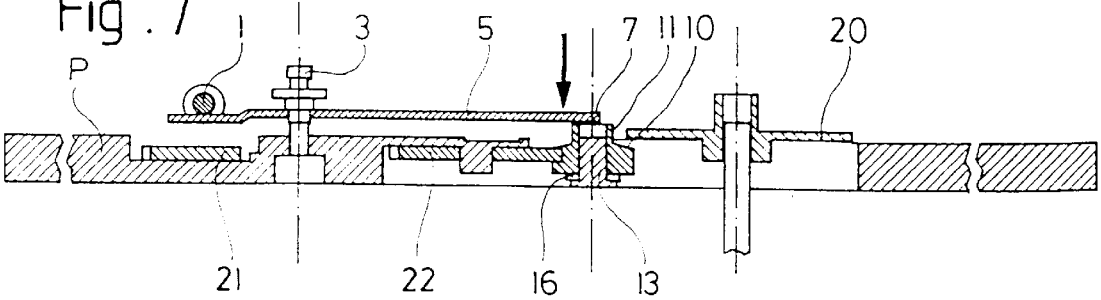
FIG. 7 is a cross-section view, in small scale, along the line VII—VII of FIG. 3 passing through the motion-work wheel.

FIGS. 6 and 7, which are respectively the views along the cross-section VI—VI of FIG. 5 and along cross-section VII—VII of FIG. 3, show even more clearly the position of the various wheels and pinions, respectively in the hand setting position and the neutral position. The arrows shown in these figures show respectively the direction in which the force of spring 15 is exerted in the hand setting position and the direction in which the pressure of arm 7 of pull-out piece 4 is exerted in the neutral position.

In a known manner, the first intermediate wheel 21 comprises a crown-like toothing which meshes with a pinion (not shown) mounted on a square portion 24 of control stem 1, said pinion being generally a sliding pinion.

The hand setting mechanism according to the invention thus offers an economical advantage by omission of a rocking bar, a construction advantage by achieving a gain in space connected to said omission and an advantage as regards the longevity of the timepiece, given that the kinematic chain is at rest in the neutral position. This last point also contributes to reducing the driving torque of the hands by the motion-work wheel, and thereby the energy consumption, which constitutes a certain advantage, in particular in the case of an electronic timepiece supplied by a battery.

What is claimed is:

1. An analogue display timepiece having a plate comprising:

a mechanism for hand setting by means of an intermediate wheel delimited by a head and a base and mobile along a shaft perpendicular to said plate of the said timepiece between at least one neutral position in which said intermediate wheel is disengaged from a motion-work wheel and a hand setting position in which it meshes with said motion-work wheel, said intermediate wheel being moved from one position to the other by translation of a hand setting stem provided with a circular groove co-operating with a pull-out piece, wherein the intermediate wheel is drawn at its base by the resilient means into the hand setting position and wherein the pull-out piece comprises an arm able to act directly on the head of the intermediate wheel in order to oppose the resilient means and to bring said intermediate wheel into the neutral position.

2. A timepiece according to claim 1, wherein the resilient means are formed by a strip-spring fixed to the plate and having a free end which acts upon the base of the intermediate wheel.

3. A timepiece according to claim 1, characterised in that the arm acting on the head of the intermediate wheel has its end inclined outwards from the plate.

4. A mechanism for hand setting an analog time piece have a plate, the mechanism comprising:

a shaft perpendicular to and connected to the plate;

a motion work wheel;

an intermediate wheel for engaging the motion work wheel, setting on and moveable, along the shaft on an axis perpendicular to the plate, between at least one neutral position, in which the intermediate wheel is disengaged from the motion work wheel, and a hand setting position, in which the intermediate wheel meshes with the motion work wheel, the intermediate wheel including a base portion and a head portion;

a pull-out piece including an arm for directly acting on the head;

a hand setting stem for moving the intermediate wheel between the at least one neutral position and the hand setting position by translation of the hand setting stem, the hand setting stem including a circular groove co-operating with the pull out piece; and a resilient member, wherein the intermediate wheel is drawn at the base by the resilient member into the hand setting position and the pull-out piece and the arm directly acts on the head portion to oppose the resilient member and bring the intermediate wheel into the at least one neutral position.

* * * * *